US007669944B2

(12) United States Patent
Oh et al.

(10) Patent No.: US 7,669,944 B2
(45) Date of Patent: Mar. 2, 2010

(54) REFRIGERATOR HAVING BASKET LIFT APPARATUS

(75) Inventors: Seung-Hwan Oh, Gyeonggi-Do (KR); Kyung-Han Jeong, Seoul (KR); Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 808 days.

(21) Appl. No.: 11/024,474

(22) Filed: Dec. 30, 2004

(65) Prior Publication Data

US 2006/0042299 A1 Mar. 2, 2006

(30) Foreign Application Priority Data

Aug. 26, 2004 (KR) ..... 10-2004-0067608

(51) Int. Cl.
*A47B 96/04* (2006.01)

(52) U.S. Cl. ..... 312/404; 312/402; 312/330.1

(58) Field of Classification Search ..... 312/404, 312/401, 400, 402, 330.1, 319.1–319.9, 304, 312/306, 307, 21–30, 223.2, 234.44; 108/144.11, 108/145–148; 62/407; 188/171, 161, 163, 188/322.5; 192/143, 144; 310/77, 93, 94; 74/49, 50, 55, 53, 411.5, 89.17, 422
See application file for complete search history.

(56) References Cited

U.S. PATENT DOCUMENTS

| | | | | | |
|---|---|---|---|---|---|
| 869,735 | A | * | 10/1907 | Rubin | 312/334.32 |
| 2,132,737 | A | * | 10/1938 | Kahn | 126/340 |
| 2,497,734 | A | * | 2/1950 | Kuklich | 312/312 |
| 2,855,262 | A | | 10/1958 | Sharpe | |
| 3,033,636 | A | | 5/1962 | Wurtz et al. | |
| 4,063,007 | A | * | 12/1977 | Spiegelberg | 429/176 |
| 5,211,461 | A | * | 5/1993 | Teufel et al. | 312/334.4 |
| 5,322,365 | A | * | 6/1994 | Teufel et al. | 312/330.1 |
| 5,429,043 | A | * | 7/1995 | Becker | 99/448 |
| 6,086,176 | A | * | 7/2000 | Aoyama | 312/286 |
| 2003/0173882 | A1 | | 9/2003 | Koons | |
| 2005/0073225 | A1 | | 4/2005 | Kwon et al. | |

FOREIGN PATENT DOCUMENTS

| | | | |
|---|---|---|---|
| DE | 3915177 | A1 * | 11/1990 |
| DE | 297 01 227 | U1 | 6/1997 |

(Continued)

*Primary Examiner*—Janet M Wilkens
*Assistant Examiner*—Timothy M Ayres
(74) *Attorney, Agent, or Firm*—Birch, Stewart, Kolasch & Birch, LLP

(57) ABSTRACT

A refrigerator having a basket lift apparatus comprises: a body having cooling chambers for storing food; a basket arranged at the lower cooling chamber to be slidable back and forth and having a door at a front side thereof; a lifting frame arranged at a rear surface of the door to be movable up and down and on which the basket is positioned; and a driving unit for lifting the lifting frame, wherein the lifting frame is composed of a first frame connected to the rear surface of the door to be movable up and down, a second frame extended from an end of the first frame with an inclination angle, and a third frame horizontally extended from an end of the second frame and on which the basket is positioned. In the refrigerator, the basket is attached or detached to or from the lifting frame more easily.

26 Claims, 11 Drawing Sheets

FOREIGN PATENT DOCUMENTS

| | | | |
|---|---|---|---|
| JP | 05-296647 | A | 11/1993 |
| JP | 5296647 | A | 11/1993 |
| JP | 2001-91151 | A | 4/2001 |
| JP | 2001-280830 | A | 10/2001 |
| JP | 2001-343186 | A | 12/2001 |
| KR | 100159711 | B1 | 8/1998 |
| KR | 1999-0035524 | U | 9/1999 |

* cited by examiner

REFRIGERATOR HAVING BASKET LIFT APPARATUS

BACKGROUND OF THE INVENTION

1. Field of the Invention

The present invention relates to a refrigerator having a basket lift apparatus, and more particularly, to a refrigerator having a basket lift apparatus capable of enhancing a user's convenience by lifting a basket installed at a lower portion of a body.

2. Description of the Conventional Art

FIG. 1 is a perspective view showing a refrigerator in accordance with the conventional art, and FIG. 2 is a sectional view of a refrigerator showing a state that a basket is accommodated in a body.

The conventional refrigerator comprises: a body 102 having an opened front side and an accommodation space; an upper cooling chamber 106 arranged at an upper side of the body 102 and having a pair of upper doors 104 opened to both sides, for storing food; and a lower cooling chamber 112 arranged at a lower side of the body 102, separated from the upper cooling chamber 106 by a partition wall 108, and having a lower door 110 opened in a slidable manner.

A mechanical chamber 116 having a compressor 114 for generating cold air to be supplied to the upper cooling chamber 106 and the lower cooling chamber 112, etc. is installed at a rear side of the body 102.

A basket 120 for accommodating food is arranged at the lower cooling chamber 112 to be slidable back and forth, and the lower door 110 is fixed at a front side of the basket 120. According to this, when the lower door 110 is pulled, the basket 120 is opened, and when the lower door 110 is pushed, the basket 120 is closed. A guide rail 124 is installed between an inner side surface of the basket 120 and an inner side surface of the lower cooling chamber 112, thereby guiding the basket 120 to be slidable back and forth.

A plurality of drawers 126 for storing food are installed at an upper side of the basket 120 to be opened in a slidable manner.

In the conventional refrigerator, when a user forwardly pulls the lower door 110 in order to take out the food stored in the lower cooling chamber 112 or in order to accommodate food in the lower cooling chamber 112, the basket 120 is opened with a slide motion. Also, when the user backwardly pushes the lower door 110 after taking out the food stored in the basket 120 or accommodating food in the basket 120, the basket 120 is closed with a slide motion.

However, in the conventional refrigerator, since the basket is arranged at a lower portion of the refrigerator, the user has to bend his or her waist or has to crouch in order to take out the food stored in the basket or to accommodate food in the basket thereby to have inconvenience in using the basket.

SUMMARY OF THE INVENTION

Therefore, an object of the present invention is to provide a refrigerator having a basket lift apparatus capable of enhancing a user's convenience by elevating a position of a basket by lifting the basket when the basket arranged at a lower portion of a body is drawn out of a lower cooling chamber.

Another object of the present invention is to provide a refrigerator having a basket lift apparatus capable of enhancing a user's convenience by facilitating to detach the basket from the basket lift apparatus.

Still another object of the present invention is to provide a refrigerator having a basket lift apparatus capable of preventing the basket from being moved in back and forth directions and in right and left directions by improving a coupling structure between a lifting frame of the basket lift apparatus and the basket.

To achieve these and other advantages and in accordance with the purpose of the present invention, as embodied and broadly described herein, there is provided a refrigerator having a basket lift apparatus comprising: a body having cooling chambers for storing food; a basket arranged at the lower cooling chamber to be slidable back and forth and having a door at a front side thereof; a lifting frame arranged at a rear surface of the door to be movable up and down and on which the basket is positioned; and a driving unit for lifting the lifting frame, wherein the lifting frame is composed of a first frame connected to the rear surface of the door to be movable up and down, a second frame extended from an end of the first frame with an inclination angle, and a third frame horizontally extended from an end of the second frame and on which the basket is positioned.

An opening portion for preventing the second frame from being interfered with components of the driving unit is formed at the second frame of the lifting frame.

A reinforcing rib for reinforcing the lifting frame is protruded at an edge of the lifting frame. The reinforcing rib is composed of: a first rib formed at an edge of the first frame; a second rib formed at an edge of the second frame; a third rib formed at an edge of a lateral surface of the third frame; and a fourth rib formed at an edge of a front surface of the third frame.

The basket is formed as a box shape in which food is accommodated, and an interference preventing portion concave towards an inner side direction of the basket is formed at a rear surface of the basket in order to prevent the basket from being interfered with components of the driving unit when the basket is descended.

A first groove for inserting the first rib formed at the lifting frame is formed at a rear surface of the basket, a second groove for inserting the third rib and preventing the basket from being moved in right and left directions is formed at a lower surface of the basket, and a third groove for inserting the fourth rib of the lifting frame and preventing the basket from being moved in back and forth directions is formed at the lower surface of the basket.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a refrigerator having a basket lift apparatus according to the present invention will be explained in more detail with reference to the attached drawings.

Even if there may exist a plurality of preferred embodiments of the refrigerator having a basket lift apparatus according to the present invention, the most preferred embodiment will be explained hereinafter.

Figure 1:
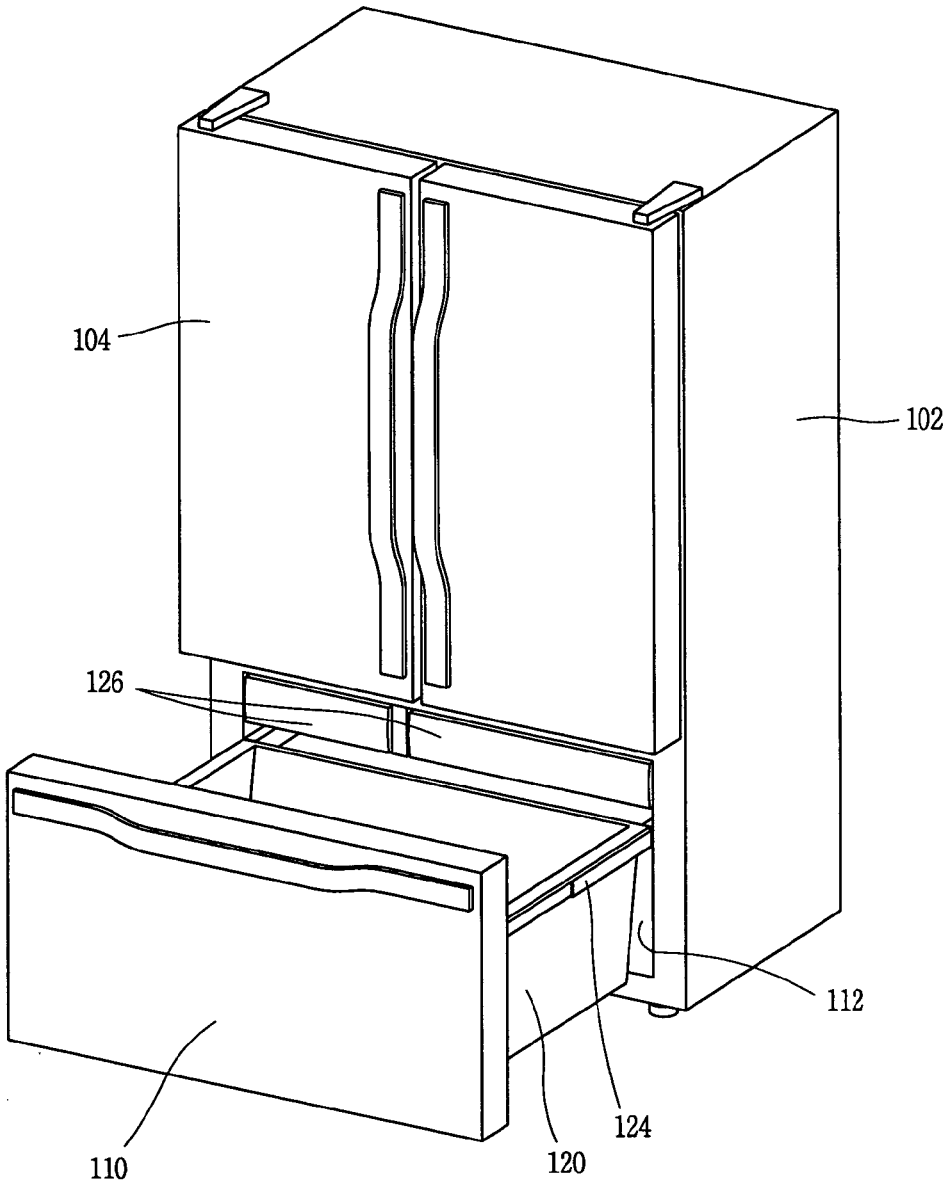
FIG. 1 CONVENTIONAL ART
FIG. 1 is a perspective view of a refrigerator in accordance with the conventional art.
Figure 2:
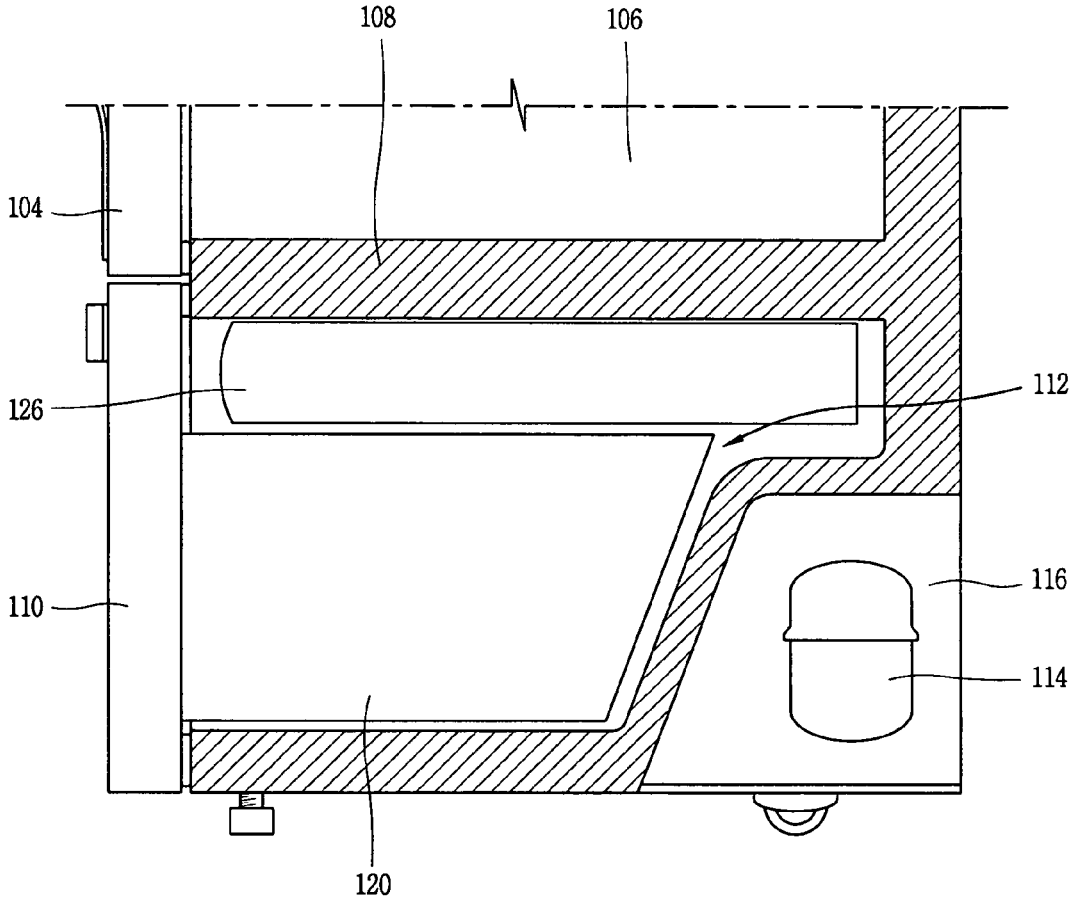
FIG. 2 CONVENTIONAL ART
FIG. 2 is a sectional view showing a lower portion of the refrigerator in accordance with the conventional art.
Figure 3:
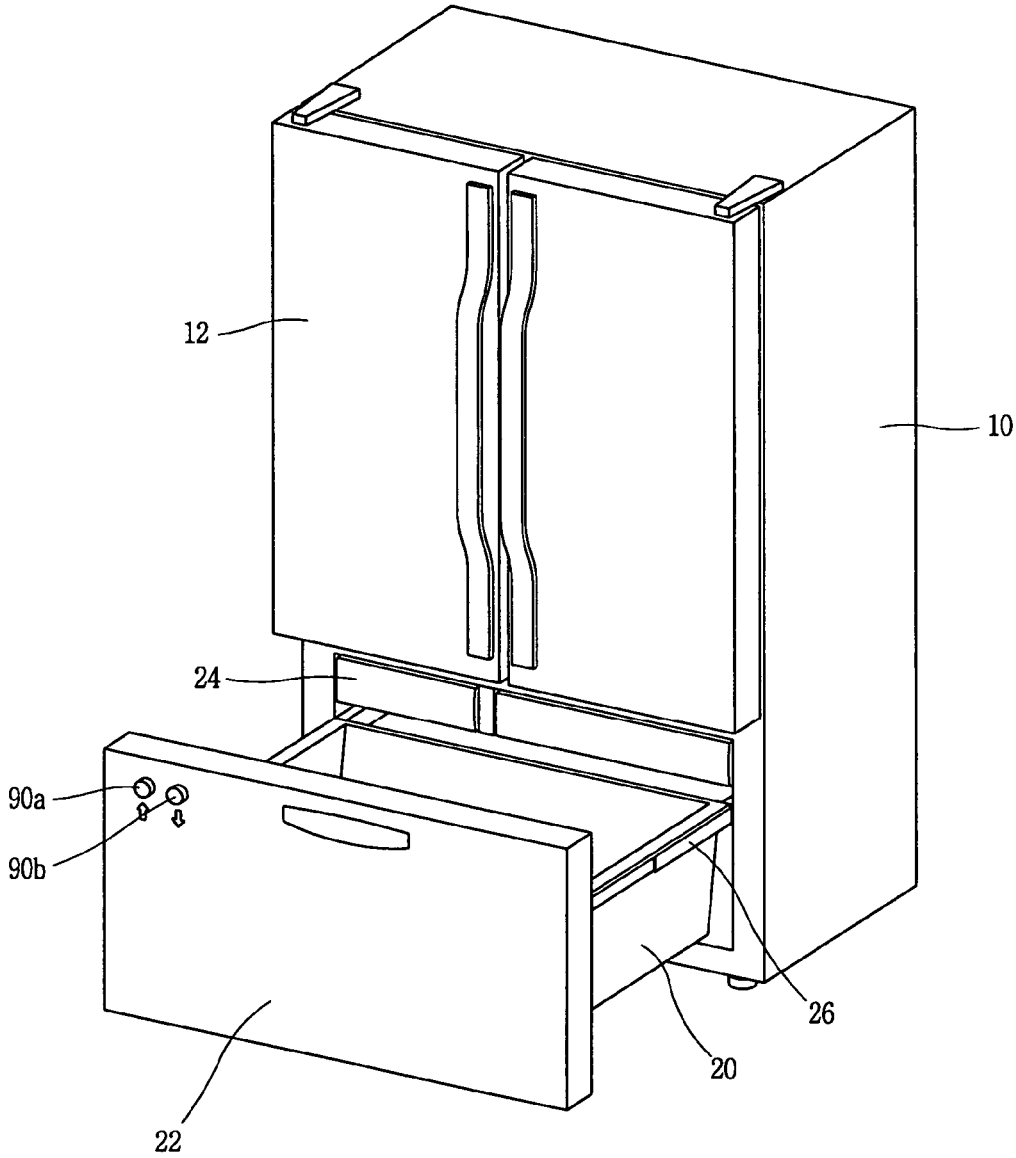
FIG. 3 is a perspective view of a refrigerator according to the present invention.
Figure 4:
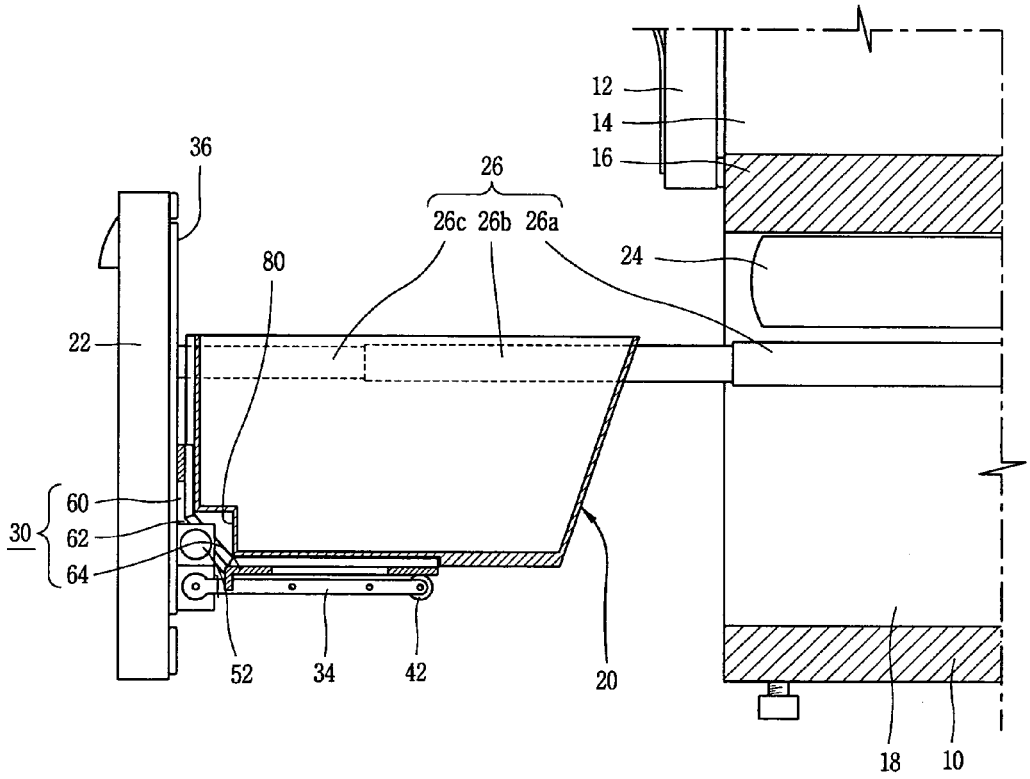
FIG. 4 is a sectional view showing a basket lift apparatus of the refrigerator according to the present invention.

FIG. 3 is a perspective view of a refrigerator according to the present invention, and FIG. 4 is a sectional view showing a basket lift apparatus of the refrigerator according to the present invention.

The refrigerator according to the present invention comprises: a body 10 having an accommodation space; an upper cooling chamber 14 arranged at an upper side of the body 10 and having a pair of upper doors 12 opened to both sides; a lower cooling chamber 18 arranged at a lower side of the body 10 and separated from the upper cooling chamber 14 by a partition wall 16; a basket 20 arranged at the lower cooling chamber 18 to be slidable back and forth, for storing food; and a basket lift apparatus for lifting up the basket 20 when the basket 20 is drawn out of the lower cooling chamber.

Preferably, the upper cooling chamber 14 is used as a cooling chamber for storing refrigerating food items, and the lower cooling chamber 18 is used as a freezing chamber for storing freezing food items.

A lower door 22 for pushing the basket 20 or drawing the basket 20 out of the lower cooling chamber 18 along back and forth directions of the body 10 is arranged at a front side of the lower cooling chamber 18. A plurality of drawers 24 drawn out along back and forth directions of the body 10 and for storing food are installed at an upper side of the lower cooling chamber 18.

A pair of guide rails 26 for guiding the lower door 22 to be slidable along back and forth directions of the body 10 is installed between both lateral surfaces of the lower cooling chamber 18 and a rear surface of the lower door 22.

The guide rail 26 is composed of: a fixed rail 26*a* fixed to both lateral surfaces of the lower cooling chamber 18; a middle rail 26*b* slidably connected to the fixed rail 26*a*; and a movable rail 26*c* slidably connected to the middle rail 26*b* and fixed to a rear surface off the lower door 22.

Figure 5:
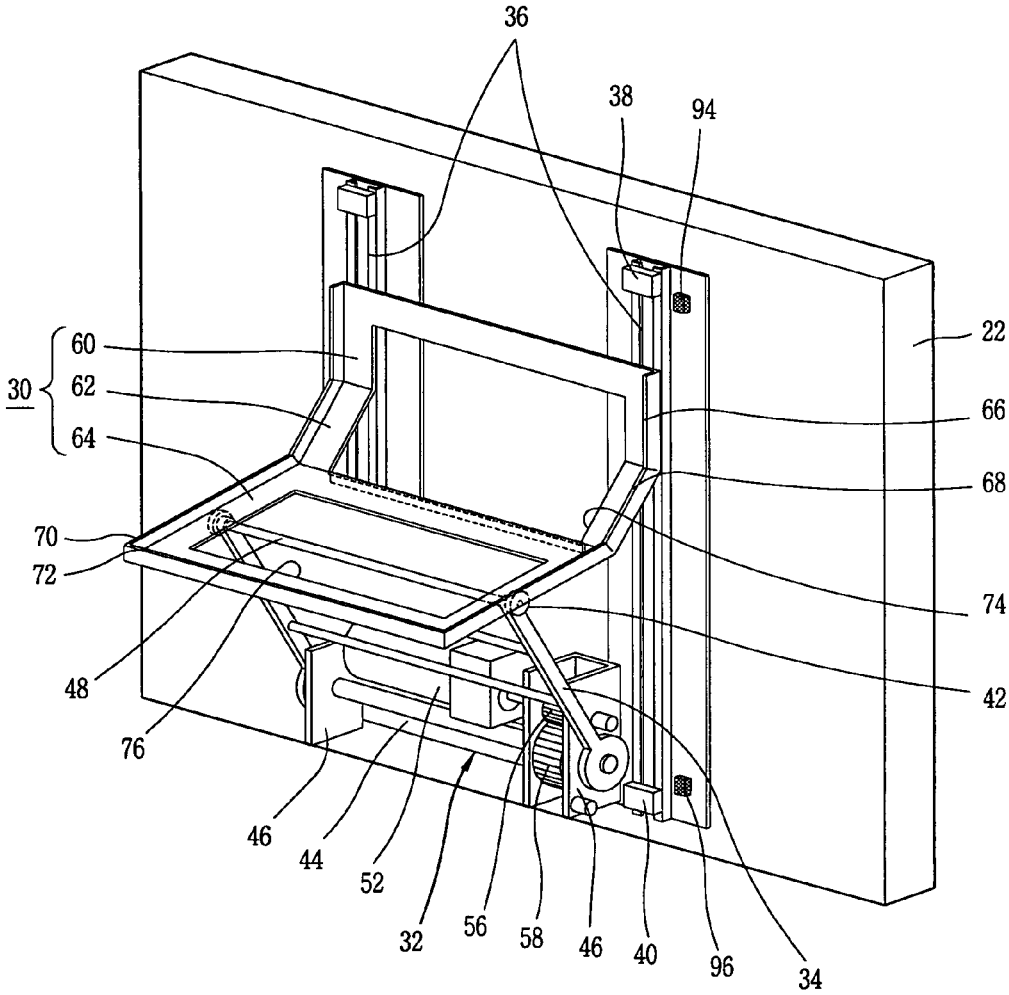
FIG. 5 is a perspective view showing the basket lift apparatus of the refrigerator according to the present invention.
Figure 6:
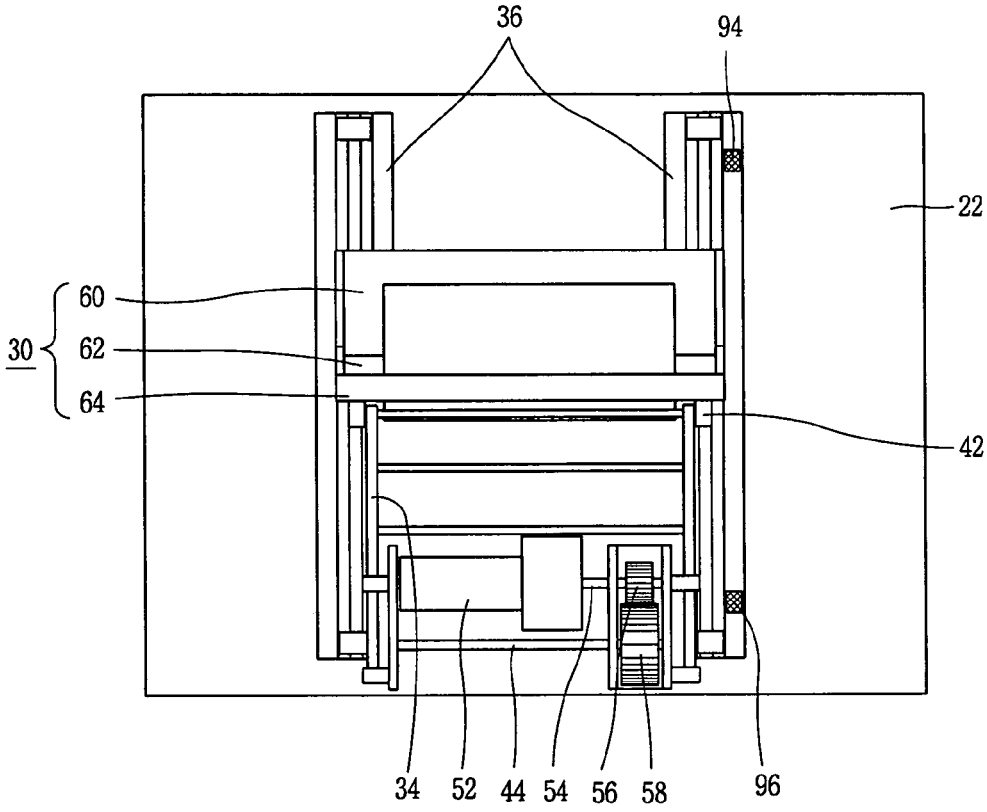
FIG. 6 is a frontal view showing the basket lift apparatus of the refrigerator according to the present invention.

As shown in FIGS. 5 and 6, the basket lift apparatus includes: a lifting frame 30 arranged at a rear surface of the lower door 22 to be movable up and down, and on which the basket 20 is positioned; a driving unit 32 for moving the lifting frame 30; and a control unit for driving the driving unit 32 and thereby lifting the basket 20 when the basket 20 is drawn out of the lower cooling chamber.

A pair of lifting rails 36 are fixed to the rear surface of the lower door 22 in a vertical direction, and the lifting frame 30 is mounted at the lifting rail 36 to be slidable up and down.

An upper stopper 38 and a lower stopper 40 are respectively mounted at an upper end and a lower end of the lifting rail 36, thereby preventing the lifting frame 30 from being detached from the lower door 22.

The driving unit 32 is composed of: a driving arm 34 roll-motioned at a lower surface of the lifting frame 30 and rotatably hinge-connected to the lower door 22; a driving motor 52 fixed to the rear surface of the lower door 22 and generating a driving force to rotate the driving arm 34; and a power transmitting unit for transmitting a driving force generated from the driving motor 52 to the driving arm 34.

A roller 42 roll-motioned at the lower surface of the lifting frame 30 is mounted at one end of the driving arm 34, and a hinge shaft 44 is mounted at another end of the driving arm 34. The hinge shaft 44 is rotatably supported at a supporting frame 46 fixed to the rear surface of the lower door 22.

The driving arm 34 is constructed as one pair respectively arranged at both sides of a lower end of the lifting frame 30, and a supporting bar 48 for supporting the driving arms 34 is mounted between two driving arms 34.

The power transmitting unit is composed of: a driving gear 56 fixed to a rotation shaft 54 of the driving motor 52 and arranged in the supporting frame 46; and a driven gear 58 gear-engaged with the driving gear 56 and fixed to the hinge shaft 44.

Figure 7:
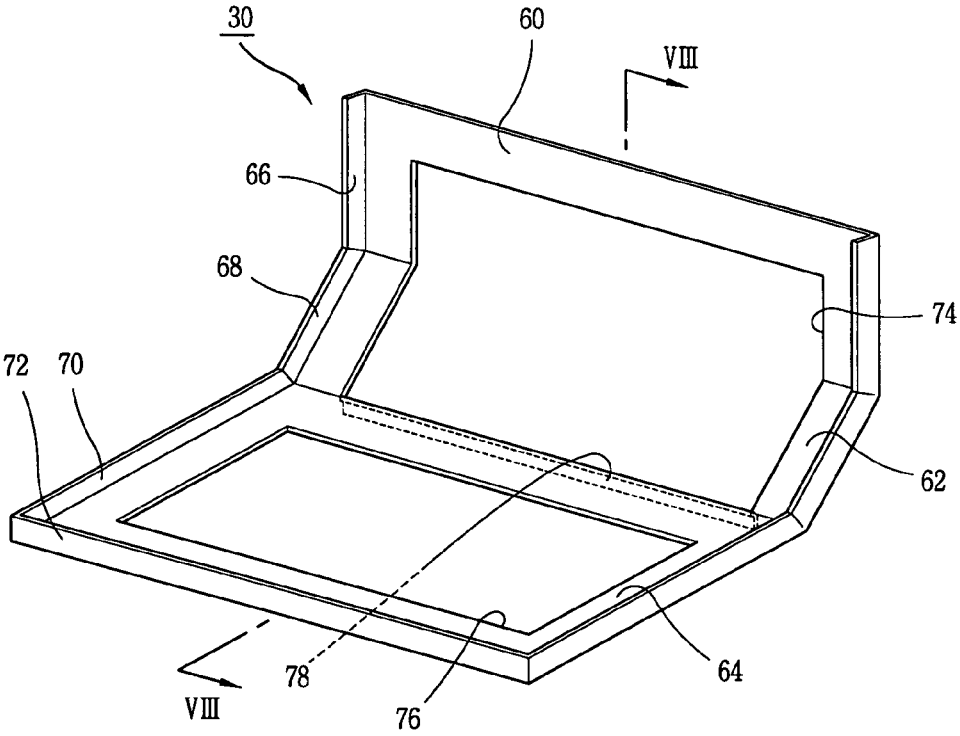
FIG. 7 is a perspective view of a lifting frame of the basket lift apparatus of the refrigerator according to the present invention.
Figure 8:
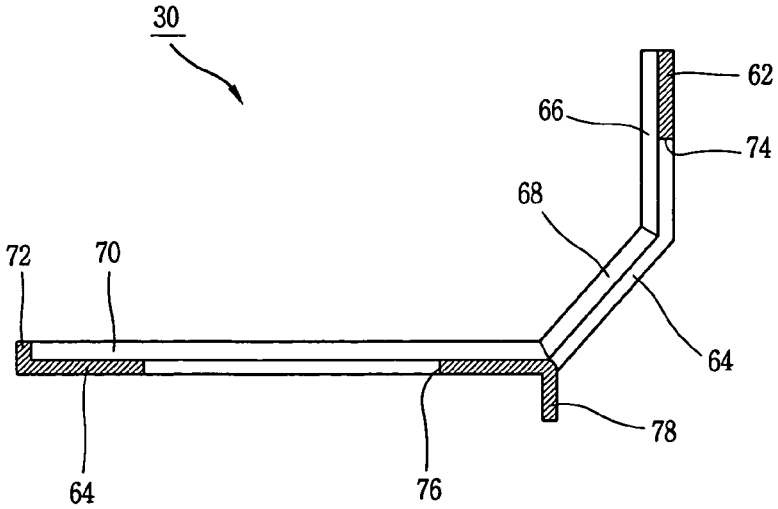
FIG. 8 is a sectional view taken along line VIII-VIII of FIG. 7.
Figure 9:
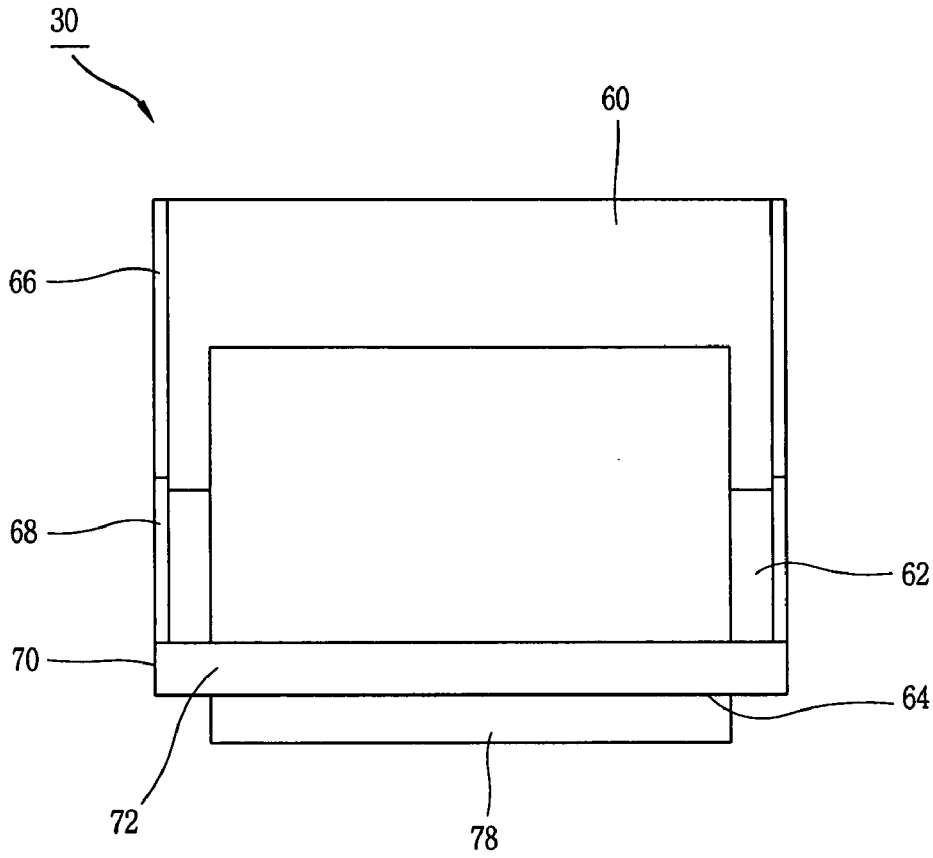
FIG. 9 is a frontal view of the lifting frame of the basket lift apparatus of the refrigerator according to the present invention.

As shown in FIGS. 7, 8, and 9, the lifting frame 30 is composed of: a first frame 60 slidably connected to the lifting rail 36; a second frame 62 bent at the end of the first frame 60 with an inclination angle, for preventing the lifting frame 30 from being interfered with components of the driving unit 32 when the lifting frame 30 is moved up and down; and a third frame 64 horizontally extended from the end of the second frame 62 and on which the basket 20 is positioned.

Reinforcing ribs 66, 68, 70, and 72 upwardly protruded with a certain width and for reinforcing the intensity of the lifting frame 30 is protruded at the edge of the lifting frame 30. The reinforcing ribs are composed of: a first rib 66 formed at edges of both sides of the first frame 60; a second rib 68 connected to the first rib 66 and formed at edges of both sides of the second frame 62; a third rib 70 connected to the second rib 68 and formed at edges of both sides of the third frame 64; and a fourth rib 72 formed at edges of a front surface of the third frame 64.

A plurality of openings 74 and 76 are formed at the lifting frame 30, and the opening 74 formed at the second frame 62 prevents the components of the driving unit 32 from being interfered with the second frame 62 by passing through the components of the driving unit 32. A stopper 78 for limiting a rotation range of the driving arm 34 and preventing the driving arm 34 from being detached from the lower surface of the lifting frame 30 is formed at a rear side of the lower surface of the lifting frame 30.

The stopper 78 is downwardly extended from the point that the second frame 62 of the lifting frame 30 meets the third frame 64 with a certain width, and stops the supporting bar 48 connected to the lifting arm 34.

Figure 10:
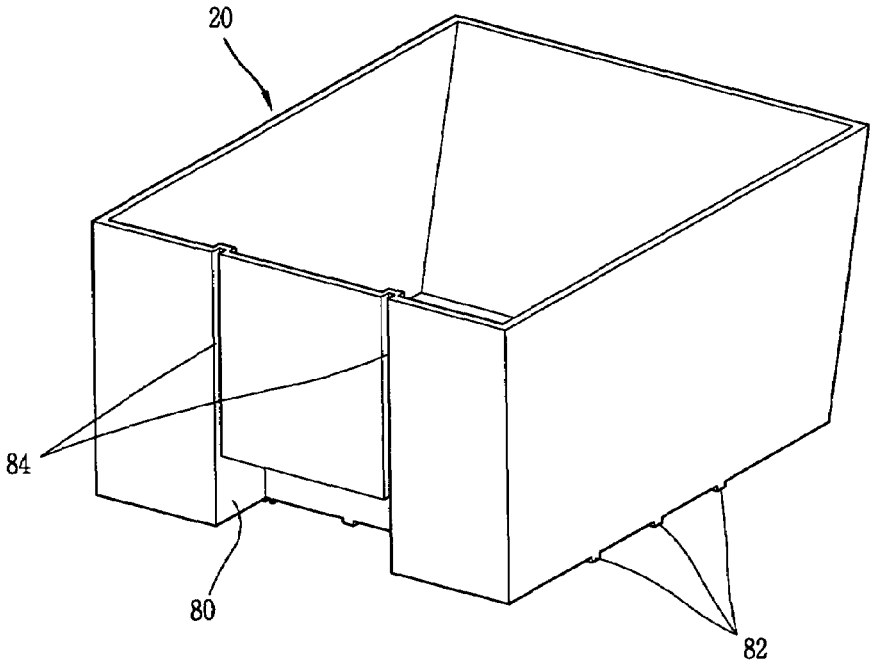
FIG. 10 is a perspective view of a basket according to the present invention.
Figure 11:
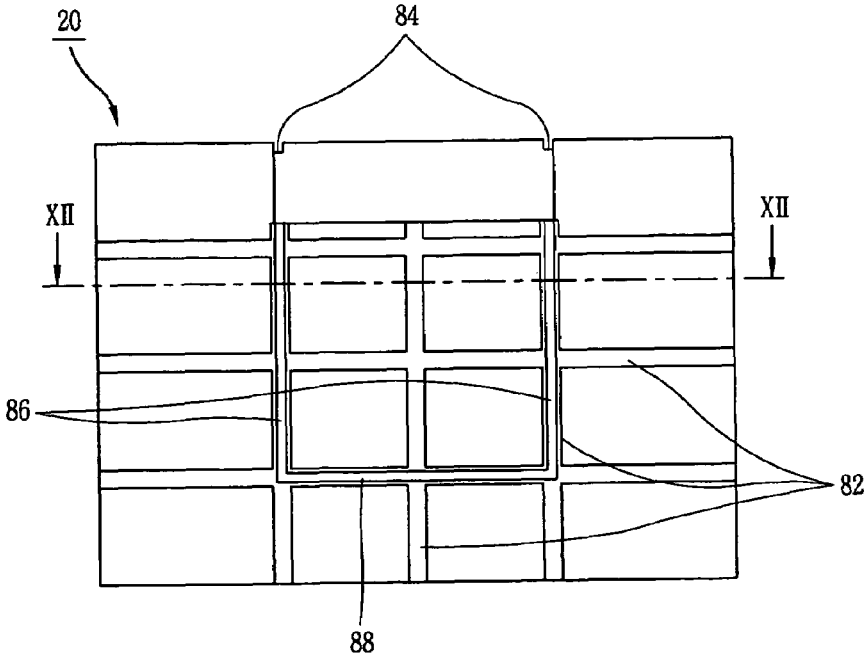
FIG. 11 is a bottom view of the basket according to the present invention.
Figure 12:
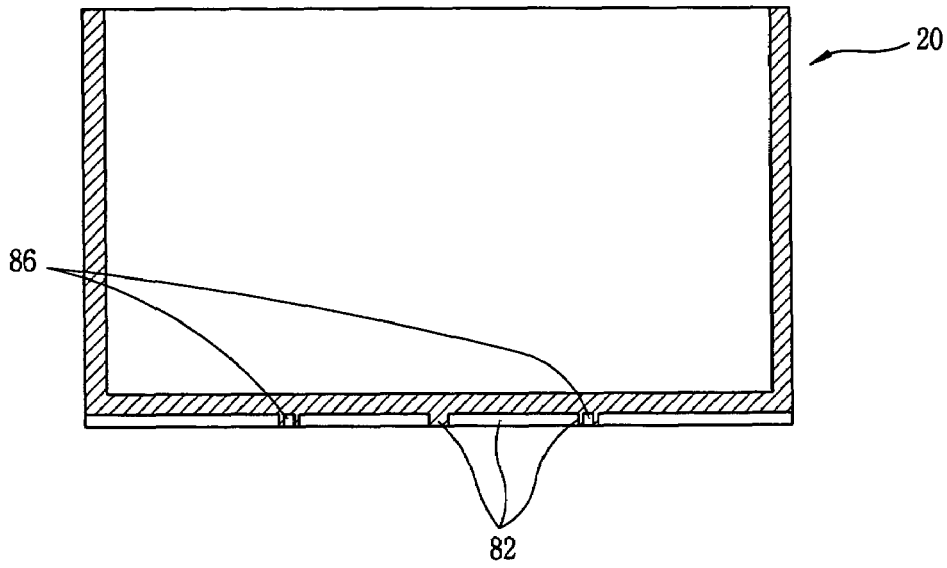
FIG. 12 is a sectional view taken along line XII-XII of FIG. 11.

As shown in FIGS. 10, 11, and 12, the basket 20 has a shape of a box having an opened upper side and stores food therein. An interference preventing portion 80 concave towards an inner side direction of the basket 20 is formed at a rear surface of the basket 20 in order to prevent an interference of the basket 20 with components of the driving unit 32 when the basket 20 is descended. Also, reinforcing ribs 82 for reinforcing the basket 20 are formed to cross one another with a certain interval at a lower surface of the basket 20.

A first groove 84 for inserting the first rib 66 of the lifting frame 30 and supporting the rear surface of the basket 20 is formed at the rear surface of the basket 20 in a vertical direction. A second groove 86 for inserting the third rib 70 of the lifting frame 30 and preventing the basket 20 from being moved in right and left directions is formed at the lower surface of the basket 20 in back and forth directions of the basket 20. Also, a third groove 88 for inserting the fourth rib 72 of the lifting frame 30 and preventing the basket 20 from being moved in back and forth directions of the basket 20 is formed at the lower surface of the basket 20 in right and lift directions of the basket 20.

Figure 13:
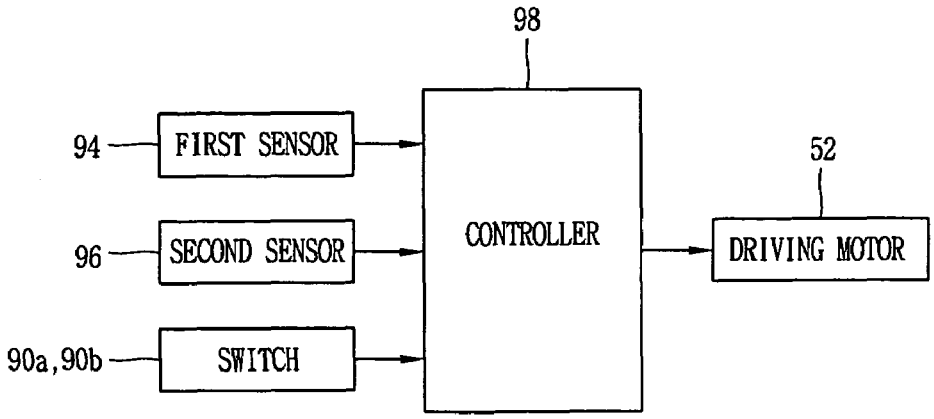
FIG. 13 is a block diagram showing a control unit of a basket lift apparatus according to one embodiment of the present invention.

As shown in FIG. 13, the control unit is composed of: switches 90*a* and 90*b* adjusted by a user in order to lift the basket 20; a first sensor 94 mounted at an upper end of the lifting rail 36, for sensing a state that the lifting frame 30 is lifted to the maximum; a second sensor 96 mounted at a lower end of the lifting rail 36, for sensing a state that the lifting frame 30 is descended to the maximum; and a controller 98 for turning on/off the driving motor 52 according to a signal applied from the switches 90*a* and 90*b*, the first sensor 94, and the second sensor 96.

The switches are composed of: a first switch 90*a* mounted at a front surface of the lower door 22 and adjusted by the user when the lifting frame 30 is to be lifted up; and a second switch 90*b* mounted at the front surface of the lower is door 22 and adjusted by the user when the lifting frame 30 is to be descended.

The first sensor 94 and the second sensor 96 are preferably constructed as a limit switch for applying a signal to the controller 98 at the time of being in contact with the lifting frame 30 or the basket 20 positioned on the lifting frame 30, or are constructed as an optical sensor.

A process for mounting the basket 20 on the lifting frame 30 will be explained as follows. The first groove 84 formed at the rear surface of the basket 20 is inserted into the first rib 66 of the lifting frame 30 and then the basket 20 is downwardly moved. According to this, the second groove 86 formed at the lower surface of the basket 20 is inserted into the third rib 70 of the lifting frame 30, thereby preventing the basket 20 from being moved in right and left directions. Also, the third groove 88 formed at the lower surface of the basket 20 is inserted into the fourth rib 72 of the lifting frame 30, thereby preventing the basket 20 from being moved back and forth.

An operation of the basket lift apparatus according to the present invention will be explained as follows.

Figure 14:
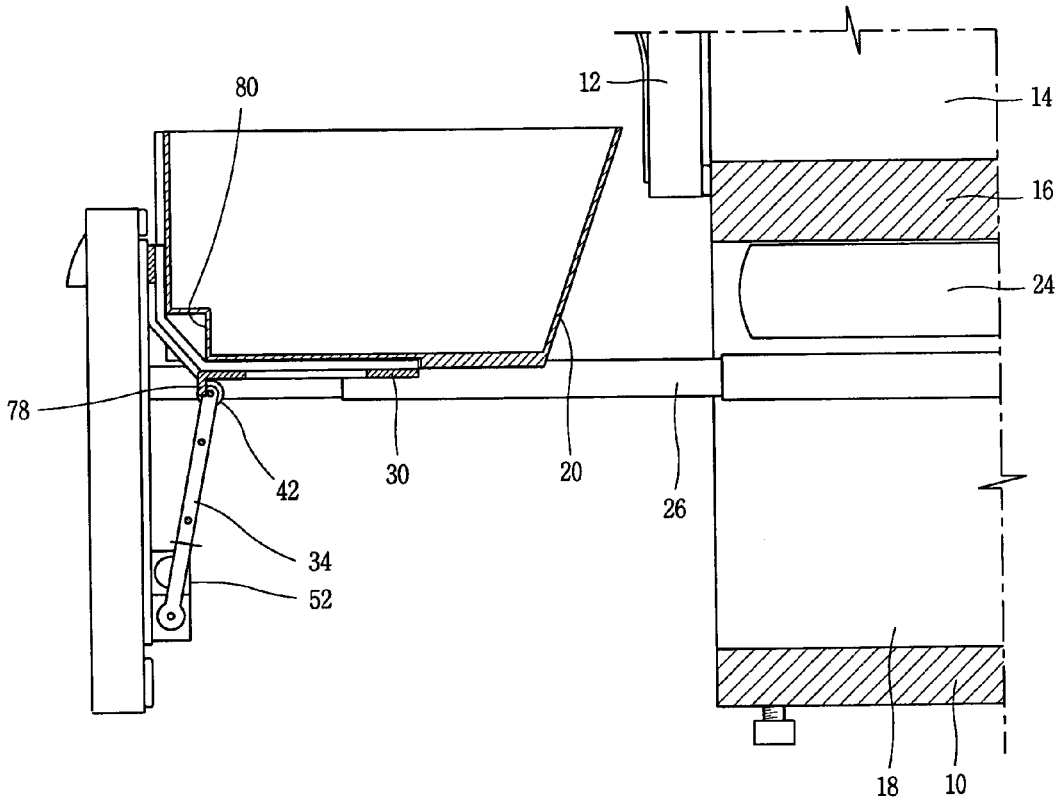
FIG. 14 is an operation state view of the basket lift apparatus according to the present invention.

FIG. 14 is an operation state view of the basket lift apparatus according to the present invention.

The user pulls forwardly the lower door 22 in order to take out food stored in the basket 20 thereby to draw the basket 20 out of the lower cooling chamber 18, and then adjusts the first switch 94*a* mounted at the front surface of the lower door 22. According to this, a signal is applied to the controller 98 from the first switch 94*a*, and then the controller 98 drives the driving motor 52 in a forward direction that the basket is lifted.

Then, the rotation shaft 54 of the driving motor 52 is rotated and thereby the driving gear 56 fixed to the rotation shaft 54 is rotated. As the driving gear 56 is rotated, the driven gear 58 gear-engaged with the driving gear 56 is rotated thereby to rotate the hinge shaft 44. According to this, the driving arm 34 fixed to the hinge shaft 44 is rotated, and thereby the roller 42 mounted at the driving arm 34 is roll-motioned at the lower surface of the lifting frame 30 thus to lift the lifting frame 30. When the lifting frame 30 is lifted to the maximum, the first sensor 94 senses the lifted state of the lifting frame 30 and applies the sensed signal to the controller 98. Then, the controller 98 stops the driving motor 52.

Under this state, when the user adjusts the second switch 94*b* after storing food in the basket 20 or taking out food from the basket 20, the controller 98 applies a power to the driving motor 52 in a backward direction. According to this, the driving motor 52 is backwardly driven thereby to descend the lifting frame 30.

When the descent of the lifting frame 30 is completed, the second sensor 96 senses the descended state of the lifting frame 30 and applies the sensed signal to the controller 98. Then, the controller 98 stops the driving motor 52. When the user backwardly pushes the lower door 22, the basket 20 is accommodated in the lower cooling chamber 18.

Effects of the basket lift apparatus according to the present invention will be explained as follows.

When the basket arranged at a lower portion of the refrigerator is drawn out of the lower cooling chamber, the basket is lifted by using the basket lift apparatus. According to this, the user can take out food stored in the basket without bending his or her waist thereby to enhance the user's convenience.

Also, the first groove formed at the rear surface of the basket is inserted into the first rib of the lifting frame, and the second groove and the third groove formed a the lower surface of the basket are respectively inserted into the third rib and the fourth rib of the lifting frame, thereby preventing the basket from being moved in back and forth directions and in right and left directions.

Also, the basket is mounted on the lifting frame as the basket is positioned on the upper surface of the lifting frame in a vertical direction, and the basket is separated from the lifting frame as the basket is lifted along an upper direction of the lifting frame, thereby facilitating to attach/detach the basket to/from the lifting frame.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A refrigerator comprising:

a body having a cooling chamber;

a door arranged at a front side of the cooling chamber;

a lifting frame movably connected to the door to move up and down, the lifting frame having an overall width dimension measured from one side of the lifting frame to the other side of the lifting frame in a first direction;

a basket having a bottom and a plurality of side walls extending upward from the bottom, the bottom of the basket being supported by the lifting frame, the bottom of the basket having a greater width in the first direction than the overall width of the lifting frame in the first direction; and a coupling structure connecting the lifting frame to the bottom of the baskets, the coupling structure including:

a reinforcing rib protruded from an edge of the lifting frame for reinforcing the lifting frame, and a groove in a bottom surface of the basket to insert the reinforcing rib formed at the lifting frame therein.

2. The refrigerator of claim 1, further comprising a driving unit for lifting the lifting frame.

3. The refrigerator of claim 2, wherein the driving unit comprises:

a driving arm roll-motioned at the lifting frame and hinge-connected to the door, for lifting the lifting frame; and a driving motor for generating a driving force for rotating the driving arm.

4. The refrigerator of claim 2, further comprising a control unit for controlling the driving unit and thereby lifting the basket.

5. The refrigerator of claim 4, wherein the control unit comprises:

a switch adjusted by a user;

a first sensor mounted at an upper end of the door for sensing a position that the lifting basket is lifted to the maximum;

a second sensor mounted at a lower end of the door for sensing a position that the lifting basket is descended to the maximum; and a controller for turning on/off a power applied to the driving motor according to a signal applied from the switch, the first sensor, and the second sensor.

6. The refrigerator of claim 1, wherein the door is provided with a lifting rail for guiding the lifting frame to be lifted.

7. The refrigerator of claim 1, wherein the lifting frame comprises:

a lifting unit connected to the door to be lifted in a perpendicular direction; and a mounting unit horizontally extended from an end of the lifting unit and on which the basket is positioned.

8. The refrigerator of claim 1, wherein the reinforcing rib comprises:

a first rib formed at an edge of the lifting unit; and a second rib formed at edges of both lateral surfaces of the mounting unit.

9. The refrigerator of claim 1, wherein the reinforcing rib further comprises a third rib formed at an edge of a front surface of the mounting unit.

10. The refrigerator of claim 8, wherein the groove includes a first groove in a rear surface of the basket for inserting the first rib formed at the lifting frame therein.

11. The refrigerator of claim 8, wherein the groove includes a second groove in the bottom of the basket for inserting the second rib therein and preventing the basket from being moved in right and left directions at the bottom of the basket.

12. The refrigerator of claim 9, wherein the groove includes a third groove in the bottom of the basket for inserting the third rib of the lifting frame therein and preventing the basket from being moved in back and forth directions at the bottom of the basket.

13. The refrigerator of claim 3, wherein the lifting frame is provided with a stopper protruded from a lower surface thereof for preventing the driving arm from being detached from the lower surface of the lifting frame.

14. The refrigerator of claim 1, wherein the coupling structure includes:

a plurality of grooves in the bottom surface of the basket; and a plurality of ribs on the lifting frame, each of the plurality of ribs being receivable in a corresponding groove of the plurality of grooves.

15. A refrigerator comprising:

a body having a cooling chamber;

a door arranged at a front side of the cooling chamber;

a lifting frame movably connected to the door to move up and down, the lifting frame having an overall width dimension measured from one side of the lifting frame to the other side of the lifting frame in a first direction, the lifting frame including:

a first frame connected to a rear surface of the door to be lifted in a perpendicular direction;

a second frame extended from an end of the first frame at an inclination with respect to the first frame; and a third frame horizontally extended from an end of the second frame and on which the basket is positioned, the second frame being oriented in a plane different from that of the third frame;

a basket having a bottom and a plurality of side walls extending upward from the bottom, the bottom of the basket being supported by the lifting frame, the bottom of the basket having a greater width in the first direction than the overall width of the lifting frame in the first direction; and a coupling structure connecting the lifting frame to the bottom of the basket such that a portion of one of the basket and the lifting frame is received in the other of the basket and the lifting frame.

16. The refrigerator of claim 15, wherein the second frame is provided with an opening for preventing an interference with components of the driving unit.

17. The refrigerator of claim 15, wherein the coupling structure includes a reinforcing rib protruded from an edge of the lifting frame for reinforcing the lifting frame.

18. The refrigerator of claim 17, wherein the reinforcing rib comprises:

a first rib formed at an edge of the first frame;

a second rib formed at an edge of the second frame; and a third rib formed at edges of both lateral surfaces of the third frame.

19. The refrigerator of claim 18, wherein the reinforcing rib further comprises a fourth rib formed at an edge of a front surface of the third frame.

20. The refrigerator of claim 15, wherein the basket is provided with an interference preventing unit concaved towards an inner side of the basket for preventing an interference with components of the driving unit when the basket is lowered.

21. The refrigerator of claim 20, wherein the basket is provided with reinforcing ribs formed to cross one another with a certain interval at a lower surface thereof for reinforcing the basket.

22. The refrigerator of claim 18, wherein the coupling structure includes a first groove at a rear surface of the basket for inserting the first rib formed at the lifting frame therein.

23. The refrigerator of claim 18, wherein the coupling structure includes second groove in the bottom of the basket for inserting the third rib therein and preventing the basket from being moved in right and left directions at a lower surface thereof.

24. The refrigerator of claim 19, wherein the coupling unit includes a third groove in the bottom of the basket for inserting the fourth rib of the lifting frame therein and preventing the basket from being moved in back and forth directions at a lower surface thereof.

25. A refrigerator comprising:

a body having a cooling chamber;

a door arranged at a front side of the cooling chamber;

a lifting frame movably connected to the door to move up and down, the lifting frame having an overall width dimension measured from one side of the lifting frame to the other side of the lifting frame in a first direction;

a basket having a bottom and a plurality of side walls extending upward from the bottom, the bottom of the basket being supported by the lifting frame, the bottom of the basket having a greater width in the first direction than the overall width of the lifting frame in the first direction; and a coupling structure connecting the lifting frame to the bottom of the basket, the coupling structure including:

at least one groove in the bottom surface of the basket; and at least one rib on the lifting frame, the at least one rib being received in the at least one groove.

26. The refrigerator of claim 25, wherein the basket includes at least one reinforcement on the bottom surface of the basket, and the at least one groove extends along the at least one reinforcement rib.

* * * * *